US006913823B2

(12) United States Patent
Pinton et al.

(10) Patent No.: US 6,913,823 B2
(45) Date of Patent: Jul. 5, 2005

(54) PROCESS FOR THE PREPARATION OF WATER REPELLENT MATERIALS MADE OF ACRYLIC FIBER

(75) Inventors: Mario Pinton, Marghera-Venezia (IT); Raffaele Tedesco, Mestre-Venezia (IT); Serafina Pane, Catanzaro (IT)

(73) Assignee: Montefibre S.p.A., Milan (IT)

( * ) Notice: Subject to any disclaimer, the term of this patent is extended or adjusted under 35 U.S.C. 154(b) by 0 days.

(21) Appl. No.: 10/202,655

(22) Filed: Jul. 25, 2002

(65) Prior Publication Data

US 2003/0049985 A1 Mar. 13, 2003

(30) Foreign Application Priority Data

Jul. 26, 2001 (IT) ..... MI2001A1619

(51) Int. Cl.[7] ..... D02G 3/00

(52) U.S. Cl. ..... 428/400; 428/172; 428/195.1; 427/539; 427/541; 427/495; 427/535

(58) Field of Search ..... 428/400, 172, 428/195.1, 283, 74, 264; 427/535, 539, 541, 495, 542, 488, 487, 388.4, 40, 41, 389.8, 416, 393.5, 208; 156/272.6, 273.3, 275.7

(56) References Cited

U.S. PATENT DOCUMENTS 4,696,830 A * 9/1987 Obayashi et al. ..... 427/491
5,122,407 A * 6/1992 Yeo et al. ..... 428/138
5,395,411 A * 3/1995 Kobayashi ..... 55/486
5,965,257 A * 10/1999 Ahluwalia ..... 428/357
6,013,153 A * 1/2000 Koinuma et al. ..... 156/272.6

FOREIGN PATENT DOCUMENTS

| | | |
|---|---|---|
| EP | 0 177 364 | 4/1986 |
| GB | 1 346 139 | 2/1974 |
| WO | WO 95/04854 | 2/1995 |

* cited by examiner

*Primary Examiner*—Merrick Dixon
(74) *Attorney, Agent, or Firm*—Oblon, Spivak, McClelland, Maier & Neustadt, P.C.

(57) ABSTRACT

A process for the preparation of water repellent acrylic fiber materials which includes (a) a first step in which the material is subjected to plasma treatment in the presence of a reactive gas or a mixture thereof with a noble gas; and (b) a second step in which the material obtained in step (a) is subjected to waterproofing by means of (i) traditional resin finish or (ii) with plasma generated in the presence of fluorinated compounds. The materials made of acrylic fiber obtained by the process have a waterproofing degree higher than 25 cm of water column and have a rigid appearance or good draping and softness depending on whether they have been water-proofed with treatment (i) or (ii). These materials may used in the preparation of covers or sun shields.

15 Claims, No Drawings

PROCESS FOR THE PREPARATION OF WATER REPELLENT MATERIALS MADE OF ACRYLIC FIBER

The present invention relates to a process for the preparation of water repellent materials made of acrylic fibre and their use for the production of end-products for external use.

Acrylic fibres have become of increasing commercial interest in the last few years for the preparation of external end-products, such as covers or sun shields, partly due to the exceptional resistance to sun radiation.

Whereas other fibres such as those from polypropylene, cotton, polyester, etc., undergo considerable deterioration in toughness after a few months of exposure to light, acrylic fibres remain unaltered and almost totally maintain their initial toughness after various years of exposure.

Before being used for external end-products, materials made of acrylic fibre are waterproofed by means of a resin finish treatment with reactive fluorinated compounds and with polymerizable compounds based on urea/formaldehyde or polyurethanes.

In this process, the material must first be washed with hot water to remove the additives, oils and lubricants (finish) present on the surface of the fibre which would otherwise prevent the formation of a continuous film during the waterproofing treatment, consequently jeopardizing the water sealing capacity.

In acrylic fibres produced with a wet process, almost the whole finish is inside the fibre and it would therefore be sufficient to remove only the surface finish to obtain a good adhesion of the waterproofing resin to the fibre. In order to be sure that the surface finish has been completely removed, however, large quantities of water must be used to reach total values of extractable products of less than 0.15%.

In conclusion, this process substantially has disadvantages deriving from the necessity of operating with large volumes of water and reagents (surface-active agents, anti-foaming agents, etc.) and a considerable energy consumption necessary for heating the water but, above all, with great problems relating to environmental impact.

The water used for the washing, in fact, extracts from the fibre, almost all of the additives used for making it processable in textile spinning and weaving. The water also extracts quantities of pigments, negligible from the point of view of weight, but with a high visual impact on the waste-products.

Furthermore, this process does not allow materials to be obtained with good draping properties required for some applications, or only to the detriment of the water repellence.

It has now been found that the use of a Plasma treatment in cleaning materials made of acrylic fibre allows the drawbacks of the known art discussed above, to be overcome.

This treatment, in fact, enables the surface of the fibre to be cleaned, without the necessity of having to remove almost the whole finish applied to the fibre, thus allowing a perfect waterproofing of the material treated.

In accordance with this, an objective of the present invention relates to a process for the preparation of water repellent materials made of acrylic fibre which comprises:

(a) a first step in which the acrylic material is subjected to Plasma treatment in the presence of a reactive gas or a mixture thereof with a noble gas; and (b) a second step in which the material obtained in step (a) is subjected to waterproofing treatment by means of (i) traditional resin finish or (ii) with Plasma generated in the presence of fluorinated compounds.

The materials made of acrylic fibre can be raw or dyed with suitably selected pigments which allow the mechanical resistance and original colour brightness to remain unaltered.

The degree of waterproofing or resistance to the water passage of a fabric is measured with the height of the water column, determined according to the UNI 5122 method.

For certain applications, such as external awnings and boat covers, the water column value must be higher than 25 cm. This value can only be obtained if the finish additives are removed to extractable product values lower than 0.15% by weight with respect to the fibre.

The quantity of residual finish with respect to the fibre is measured by extraction with ethyl alcohol in soxhelet at reflux temperature for three hours using an alcohol/fibre ratio of 20:1 and determining the residue after evaporation of the alcohol in a ventilated oven at 60° C. for 12 hours.

It has been observed, in fact, that if the level of residual finish with respect to the fibre is higher than 0.15%, the water column value which can be obtained is lower than 25 cm up to values close to zero in relation to the quantity of finish remaining on the fibre. This confirms that the residual finish prevents a perfect adhesion of the waterproofing resin to the fibre with the consequent possibility of water passing through the end-product.

Treatment by means of the Plasma technology allows the surface alone of the fibre to be cleaned, consequently without the necessity of removing almost the whole finish applied to the fibre, thus enabling a perfect adhesion of the waterproofing resin, obtaining water column values higher than 25 cm.

The Plasma treatment is effected on perfectly dry materials, as they leave the loom, and does not require the use of any of water for the removal of the finish.

In step (a) of the process of the present invention, the reactive gas is preferably oxygen.

A mixture of Oxygen/Argon is preferably used, with a molar ratio between the two gases ranging from 10:5 to 10:1.

The reaction is carried out at a residual pressure ranging from 50 to 150 mtorr, at a temperature ranging from 40 to 70° C. and the power applied ranges from 500 to 2000 watts.

In step (b) of the process of the present invention, the waterproofing can be carried out according to traditional techniques.

In particular, the material made of acrylic fibre is subjected to impregnation treatment by immersion of the end-product in a bath comprising reactive fluorinated products available on the market, such as FC$^R$ 251 (3M), Oleophobol$^R$ (Ciba), urea/formaldehyde resins, for example Kaurit$^R$ S of BASF, in addition to other aids for improving the dispersion of the components, polymerization catalysts, etc., with subsequent polymerization and drying in an oven capable of reaching a temperature of 160–180° C.

According to another embodiment, the waterproofing can be effected with Plasma generated in the presence of fluorinated compounds (ii).

Examples of fluorinated compounds are selected from hexafluorobutadiene, hexafluoro propylene, $CF_4$, $C_2F_6$, etc. Hexafluoro propylene is preferably used.

The reaction is carried out at a residual pressure of 50+100 mtorr, at a temperature of 50+80° C., at an applied power of 1500+2500 watts and with a residence time of 3 minutes.

Operating as described above, a water repellent material made of acrylic fibre is obtained, capable of maintaining its draping property and initial softness, contrary to end-products treated with the traditional resin finish techniques.

Another advantage of the water repellent coating obtained by means of Plasma is the absence of pigment bleeding also with unwashed end-products. When a good draping effect is to be maintained, in fact, in the use of end-products for beach umbrellas, deckchairs or garden furniture, at least one washing with water is effected on the material to remove the pigments extractable from the finish and avoid the dirtying of the lighter parts of fabric on the part of the pigments extracted from the darker parts of the fabric by rainwater.

The Plasma treatment with fluorinated compounds prevents the penetration of water inside the fibre and therefore the extraction of pigments.

The plasma treatment in step (a) and (b-ii) of the process according to the present invention can be carried out using the equipment available on the market.

A machine for the plasma treatment in continuous of textile end-products is illustrated for example in U.S. Pat. No. 4,457,145.

Materials made of acrylic fibre obtained with the process of the present invention can be used in the produced of beach-umbrellas, boat covers, convertible car roofs, beach or garden chairs, sun-shades, etc.

The following examples, whose sole purpose is to describe the present invention in greater detail, should in no way be considered as limiting the scope of the invention itself.

EXAMPLES 1–6

The material made of acrylic fibre was subjected to treatment with plasma in an atmosphere of a mixture of Argon and Oxygen (molar ratio 10:1), for different times (3, 5 and 10 minutes).

Three samples were prepared as a comparison, of which: two were subjected to the traditional washing process in water (B, C) and the other was not treated (A).

All the samples were subsequently treated with the traditional waterproofing system consisting in impregnation of the fabric in a bath containing: acetic acid (60%) 2 ml/l, a melaminic resin Lyofix$^R$ (MLF) 8 ml/l, a catalyst Knittex ZH based on $ZnCl_2$ 8 ml/l, an emulsion of fluoropolymers Oleophobol$^R$ S (Ciba). After immersion, the fabric was squeezed between two rolls and then thermally treated at a temperature of 170° C. to allow both the removal of the water and polymerization.

The samples were subjected to mechanical wear tests by means of Martindale (ISO 1297 method at 2000 cycles) In none of the cases was a significant effect of wear on the water column observed.

TABLE 1

| Sample | Cleaning with plasma | Cleaning with water | Extractable products % | Water column (cm) As such | Water column (cm) After wear |
|---|---|---|---|---|---|
| A | NO | NO | 0.64 | 10 | 8 |
| B | NO | YES | 0.3 | 15 | 12 |
| C | NO | YES | 0.15 | 32 | 32 |
| D | 3 min. | NO | 0.601 | 29 | 29 |
| E | 5 min. | NO | 0.522 | 30 | 30 |
| F | 10 min. | NO | 0.516 | 32 | 32 |

From the data indicated in the table, the various levels of extractable products required for the two cleaning techniques to obtain acceptable water column height values (>28 cm), can be observed. In the plasma treatment process, it is sufficient to only remove the finish on the surface of the fibre to allow a perfect adhesion of the traditional waterproofing treatment resin.

EXAMPLE 7

Waterproofing of a Fabric Made of Acrylic Fibre by Plasma Coating with Fluorinated Compounds.

Sample E of the previous example, after cleaning with plasma, was treated in the same equipment with hexafluoro propylene plasma gas for 3 minutes at 70° C., with a power of 2000 watts. The results are indicated in Table 2.

TABLE 2

| Sample | Cleaning with plasma | Cleaning with water | Extractable products % | Water column (cm) As such | Water column (cm) After wear |
|---|---|---|---|---|---|
| G | 5 min. | NO | 0.522 | 35 | 32 |

The end-products treated with this procedure preserve the initial softness and draping effect.

What is claimed is:

1. A process for the preparation of a water repellent acrylic fiber material which comprises:

(a) first, plasma treating an acrylic fiber material in the presence of a reactive gas or a mixture of a reactive gas and a noble gas; and (b) second, waterproofing the plasma treated acrylic fiber material with at least one of (i) a resin finish or (ii) a plasma generated in the presence of one or more fluorinated compounds.

2. The process according to claim 1, wherein the plasma treating is carried out with a mixture of a reactive gas and a noble gas, and the molar ratio of the reactive gas to the noble gas is from 10:5 to 10:1.

3. The process according to claim 1, wherein the reactive gas is $O_2$.

4. The process according to claim 1, wherein the plasma treating is carried out in the presence of Argon.

5. The process according to claim 1, wherein the plasma treating is carried out at a temperature of from 40 to 70° C. for from 2 to 5 minutes.

6. The process according to claim 1, wherein waterproofing includes applying a resin finish by immersing the plasma treated acrylic fiber material in a bath containing a reactive fluorinated compound, a urea/formaldehyde resin, and one or more aids for improving the dispersion of the components in the presence of a polymerization catalyst, and subsequent polymerization and drying.

7. The process according to claim 1, wherein waterproofing is carried out with one or more fluorinated compounds selected from the group consisting of hexafluoro butadiene, hexafluoro propylene, $CF_4$, and $C_2F_6$.

8. The process according to claim 7, wherein the fluorinated compound is hexafluoro propylene.

9. A water repellent acrylic fiber material obtained by the process according to claim 1 having a column height higher than 28 cm.

10. The water repellent acrylic fiber material according to claim 9 which can be used in the preparation of covers or sun shields.

11. The process according to claim 1, further comprising dying the acrylic fiber material.

12. The process as claimed in claim 1, wherein the acrylic fiber material is dried before plasma treating.

13. The process as claimed in claim 5, wherein plasma treating is carried out at a pressure of from 50 to 150 mTorr.

14. A water repellent acrylic fiber material obtained by the process according to claim 1.

15. The process as claimed in claim 1, which consists of:

(a) first, plasma treating; and (b) second, waterproofing.

* * * * *